US006434347B2

(12) United States Patent
Nakayasu

(10) Patent No.: US 6,434,347 B2
(45) Date of Patent: Aug. 13, 2002

(54) PRINTING APPARATUS AND TONER DENSITY MEASURING METHOD

(75) Inventor: Hirofumi Nakayasu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/759,261

(22) Filed: Jan. 16, 2001

(30) Foreign Application Priority Data

Jul. 3, 2000 (JP) ..... 2000-200523

(51) Int. Cl.[7] ..... G03G 15/00; G03G 15/01
(52) U.S. Cl. ..... 399/49; 250/339.11; 250/341.8
(58) Field of Search ..... 399/49, 41, 299; 347/131; 358/504, 406, 296, 298; 250/341.8, 339.11; 356/445

(56) References Cited

U.S. PATENT DOCUMENTS 4,989,985 A 2/1991 Hubble, III et al. ..... 356/445
5,873,011 A * 2/1999 Takemoto et al. ..... 399/49
5,907,344 A 5/1999 Tanimoto et al. ..... 347/131
5,946,523 A 8/1999 Fujioka et al. ..... 399/49

FOREIGN PATENT DOCUMENTS

| | | |
|---|---|---|
| JP | 02-256076 | 10/1990 |
| JP | 10-221902 | 8/1998 |
| JP | 10-282783 | 10/1998 |
| JP | 10-333395 | 12/1998 |
| JP | 11-153887 | 6/1999 |
| JP | 11-153888 | 6/1999 |

* cited by examiner

*Primary Examiner*—Sophia S. Chen
(74) *Attorney, Agent, or Firm*—Armstrong, Westerman & Hattori, LLP

(57) ABSTRACT

A toner mark transfer unit transfers a halftone pattern such as a transverse line pattern or a slanted line pattern on a belt by using a plurality of electrostatic recording units. A toner density measurement unit figures out density control parameters such as emission time and emission current on the basis of the ratio of a reflected light (inter-line space width) from the toner free portion to a light (line width) attenuated due to a diffuse light from the toner bearing portion in a read signal of a halftone pattern from a sensor unit.

14 Claims, 17 Drawing Sheets

PRIOR ART

TONER MARK

YMC COLOR TONER OUTPUT SIGNAL

K TONER OUTPUT SIGNAL

NO TONER

SMALL QUANTITY OF TONER

LARGE QUANTITY OF TONER

PD OUTPUT SIGNAL

SAMPLING PULSE

SAMPLING GATE

FIG. 13

| WHITE-TO-BLACK RATIO | EMISSION TIME |
|---|---|
| LESS THAN 30% | ERROR |
| NOT LESS THAN 30% AND LESS THAN 40% | 10μs |
| NOT LESS THAN 40% AND LESS THAN 50% | 12μs |
| NOT LESS THAN 50% AND LESS THAN 60% | 14μs |
| NOT LESS THAN 60% AND LESS THAN 70% | 16μs |
| NOT LESS THAN 70% | ERROR |

(EMISSION CURRENT CONSTANT 10mA)

FIG. 14

| WHITE-TO-BLACK RATIO | EMISSION CURRENT |
|---|---|
| LESS THAN 30% | ERROR |
| NOT LESS THAN 30% AND LESS THAN 40% | 10mA |
| NOT LESS THAN 40% AND LESS THAN 50% | 12mA |
| NOT LESS THAN 50% AND LESS THAN 60% | 14mA |
| NOT LESS THAN 60% AND LESS THAN 70% | 16mA |
| NOT LESS THAN 70% | ERROR |

(EMISSION TIME CONSTANT 10μs)

Y TONER OUTPUT SIGNAL

M TONER OUTPUT SIGNAL

C TONER OUTPUT SIGNAL

K TONER OUTPUT SIGNAL

PRINTING APPARATUS AND TONER DENSITY MEASURING METHOD

BACKGROUND OF THE INVENTION

1. Field of the Invention

The present invention relates generally to a printer for printing full color images through a superposed transfer of different color images by use of a plurality of electrostatic recording units equipped with an electrophotographic record printing function, and to a toner density measuring method for use therein. More particularly, the present invention relates to a printer in which the toner density is measured by optically detecting Y, M, C and K toners transferred onto the surface of a conveyance belt, as well as to a toner density measuring method for use therein.

2. Description of the Related Arts

In the conventional color printers using electrophotographic recording, four electrostatic recording units for black (K), cyan (C), magenta (M) and yellow (Y) are arranged in tandem in the direction where record sheets are conveyed. The electrostatic recording units for four colors each optically scan a photosensitive drum on the basis of image data to form a latent image thereon, develop the latent image with a color toner in the developing device, and thereafter transfer the toner image onto record sheets being conveyed at a constant speed, in a superposed manner in the order of yellow (Y), magenta (M), cyan (C) and black (K), and finally perform a thermal fixation of the transferred image through a fixing device. It is necessary for the printers having Y, M, C and K electrostatic recording units arranged in tandem in the record sheet conveying direction to reduce the positional offset of the toner image transferred onto the record sheets in motion by each electrostatic recording unit to thereby enhance the color matching accuracy in order to improve the color printing quality. To this end, such tandem-type printers perform a color matching process in which a toner mark is transferred onto the surface of the conveyance belt upon the power on or the cover opening or closing, the toner mark being read by e.g., a sensor to vary the write timing of the LEDs or laser diodes making up an exposure device to thereby regulate the color drift and the toner density.

The conventional printers use a sensor as depicted in FIG. 1 to detect the toner density. The sensor designated at 104 comprises an LED lamp 106 for issuing a spot light of the order of 8 millimeters in diameter on the surface of the belt 108 and a photodiode 112 for receiving a diffusely reflected light from the toner 110 lying on the spot light region. In the sensor circuit, as shown in FIG. 2 the diffusely reflected light from the toner 110 on the belt surface 108 originating from the LED lamp 106 is received by the photodiode 112 and thereafter amplified by an amplifier 114 having a negative feedback circuit composed of a resistor 116, and further amplified by amplifiers 118 and 120, sampled by an A/D converter 122 and entered as light reception data into an MPU 124 to determine the density control parameter such as the emission time of the exposure LEDs corresponding to the toner density from the light reception data. The toner density regulation includes setting the density control parameter which is optimum for the default, e.g., the optimum emission time in four stages as 8 $\mu$s, 13 $\mu$s, 18 $\mu$s and 23 $\mu$s, transferring the toner in each emission time to determine the density, converting the measured density into the emission time to obtain a lag relative to the optimum emission time, and correcting the optimum emission time from this lag to regulate the toner density upon the printing to the optimum value.

However, such a conventional method for measuring the toner density from the diffusely reflected light from the toner transferred onto the belt surface has a deficiency that the Y, M and C color toners have a different reflectance from that of the K black toner so that the density of black toner cannot be detected. For example, assume as in FIG. 3A that slanted lines are transferred at a constant pitch by the LED exposure device, with the LEDs' emission current unvaried and with the emission time varied to e.g., 8, 13, 18 and 23 to increase the line width so that toner transfer patterns 128, 130, 132, 134 are transferred onto the belt surface in the order of thinness. When this toner transfer pattern is read by the sensor 104 of FIG. 1, light reception signals corresponding to the toner density (amount of adhesion of toner) are obtained as in FIG. 3B in the case of the Y, M and C color toners. More specifically, in the case of the Y, M and C color toners although there exists a slight difference thereamong, when a light from the LED lamp 106 is irradiated on the toners, the light diffusely reflected on the Y, M and C toners impinges on the photodiode 112. At that time, a higher density with a large amount of adhesion of toner results in a larger quantity-of-light diffusely reflected on the toner, whereas a lower density with a small amount of adhesion of toner results in a smaller quantity-of-light diffusely reflected on the toner, whereby the Y, M and C toner density can be measured from the magnitude of the diffusely reflected light received by the photodiode 106 as shown by way of an example in FIGS. 3A and 3B, where toner marks 128, 130, 132 and 134 with progressively increasing density being respectively shown to have increasing magnitude of output signals 136, 138, 140 and 142. However, the K black toner exceptionally has a high light absorbance and presents an extremely less variation of the diffusely reflected light arising from the amount of adhesion of toner as shown in FIG. 5C. For this reason, a problem is posed that the sensor of FIG. 1 is unable to determine the density of the K black toner. On the contrary, in order to obtain only the K black toner density, it will suffice to irradiate the toner transfer surface with the LED lamp to receive the regularly reflected light therefrom, where the higher the toner density, the lower is the reflection, as shown by way of an example where the toner mark density is increased from signal 136 to 138 in FIG. 3B, but the reflection output signal is decreased to a lower output signal level 144 in FIG. 3C. However, this approach may be problematic in that there is a need to provide two different types of sensors, i.e., the sensor for black toner and the sensor for color toners as shown in FIG. 1, which leads to a complicated sensor arrangement, sensor circuit and sensor structure, resulting in a rise of costs.

In recent years, as shown in FIG. 4, a sensor 146 is provided with a photodiode 112 for receiving a diffusely reflected light from the LED lamp 106 and with a photodiode 148 for receiving a regularly reflected light therefrom to provide an integrated sensor structure allowing the simultaneous measurement of the Y, M and C color toners and K black toner. However, this sensor also necessitates the two photodiodes 112 and 148 for the black toner and for color toners, with the need for two reception light amplifying circuits of FIG. 1. Thus, the same deficiency still remains left as in the case of use of the two sensors for black toner and the color toners excepting that the single sensor placement is sufficient.

SUMMARY OF THE INVENTION

According to the present invention there are provided a printing apparatus capable of measuring the density of both Y, M and C color toners and K black toner by the combination of a single light emitting element and a single light receiving element and equipped with a sensor function having a simple structure and circuit configuration and easy to install, and a toner density measuring method for use therein.

The present invention is directed to a printing apparatus comprising a belt unit which conveys record sheets on a belt at a constant speed, the record sheets being electrostatically adhered to the surface of the belt; and a plurality of electrostatic recording units arranged in the direction of conveyance of the record sheets, the electrostatic recording units forming a latent image corresponding to image data through an optical scanning on a photosensitive drum in rotation by an exposure device, the electrostatic recording units developing the latent image with a toner component of different color, to thereafter transfer the developed image onto the record sheets lying on the surface of the belt. The present invention provides such a printing apparatus with a toner mark transfer unit which transfers a halftone pattern onto the surface of the belt by use of the plurality of electrostatic recording units; a sensor unit which optically reads the halftone pattern transferred onto the surface of the belt; and a toner density measurement unit which measures the toner density on the basis of the ratio of a reflected light from a toner bearing portion to a reflected light from a toner free portion in a read signal of the halftone pattern from the sensor unit.

The toner transfer unit transfers a transverse line pattern or a slanted line pattern on the surface of the belt, the line width of the transverse line pattern or of the slanted line pattern varying in proportion to the density. The toner density measurement unit samples at a predetermined cycle a sensor output signal of the transverse line pattern or of the slanted line pattern transferred onto the surface of the belt, the toner density measurement unit figuring out as the toner density a white-to-black ratio NL/(NL+NH) from the number NH of sampled data having a higher value than a predetermined threshold value and from the number NL of sampled data having a lower value than the threshold value. The toner density measurement unit refers to table information previously defining the relationship between the white-to-black ratio and a density control parameter, to determine the density control parameter corresponding to the amount of adhesion of toner. In this case, the density control parameter to be determined by the toner density measurement unit is the emission time when the amount of current flowing per dot of the exposure device is constant or the amount of current when the emission time per dot of the exposure device is constant. The the sensor unit includes a condenser lens through which a light from a laser diode impinges on the belt transfer surface in the form of a spot light of the order of several tens of microns, the sensor unit when no toner components adhered providing as its output a signal of a reflected light by irradiation of the spot light, the reflected light being received by a light reception element arranged in the direction of a predetermined output angle, the sensor unit when toner components adhered providing as its output a signal of a light attenuated due to scattering by irradiation of the spot light, the attenuated light being received by the light reception element. The sensor unit has an incident angle θ1 from the laser diode relative to the belt surface and an output angle θ2 from the belt surface relative to the light receiving element, the incident angle θ1 and the output angle θ2 being set to the range of 60 to 80 degrees, preferably to the vicinity of 70 degrees. In this manner, the present invention allows the toner density to be measured from the line width substantially proportional to the amount of adhesion of toner of the transverse line pattern or the slanted line pattern transferred in the form of the halftone pattern, whereby it is possible to obtain the toner density through secure determination of the line width from the sensor read signal with possible attenuated quantity-of-light for not only the YMC color toners but also for K black toner without relying on the toner reflectance as in the conventional toner density measurement based on the reception signal of a reflected light by the toner diffuse reflection or regular reflection. It is also possible to measure the K black toner and the Y, M and C color toners by the same sensor, the same circuit and the same algorithm, with the high resistance to the analog noises and acquisition of stably high measurement accuracy by virtue of the detection of the line width. Furthermore, the sensors for the toner density detection can be of the same sensor structure as that of the sensor for correcting the toner positional offset which similarly effects its work through the toner mark transfer on the belt surface, whereby a single sensor can be used for both the toner positional offset and the toner density measurement to thereby reduce the costs.

The present invention further provides a toner density measuring method for a printing apparatus having a belt unit which conveys record sheets on a belt at a constant speed, the record sheets being electrostatically adhered to the surface of the belt, and having a plurality of electrostatic recording units arranged in the direction of conveyance of the record sheets, the electrostatic recording units forming a latent image corresponding to image data through an optical scanning on a photosensitive drum in rotation by an exposure device, the electrostatic recording units developing the latent image with a toner component of different color, to thereafter transfer the developed image onto the record sheets lying on the surface of the belt, the method comprising the steps of transferring a halftone pattern onto the surface of the belt by use of the plurality of electrostatic recording units;

optically reading the halftone pattern transferred onto the surface of the belt, by use of a sensor unit; and measuring the toner density on the basis of the ratio of a reflected light from a toner bearing portion to a reflected light from a toner free portion in a read signal of the halftone pattern.

The details of the toner density measuring method are substantially the same as those of the printing apparatus.

The above and other objects, aspects, features and advantages of the present invention will become more apparent from the following detailed description when read in conjunction with the accompanying drawings.

BRIEF DESCRIPTION OF THE DRAWINGS

FIG. 13 is an explanatory diagram of a density control parameter table of FIG. 9 with respect to the emission time;

FIG. 14 is an explanatory diagram of the density control parameter table of FIG. 9 with respect to the emission current;

DETAILED DESCRIPTION OF THE PREFERRED EMBODIMENTS

Figure 1:
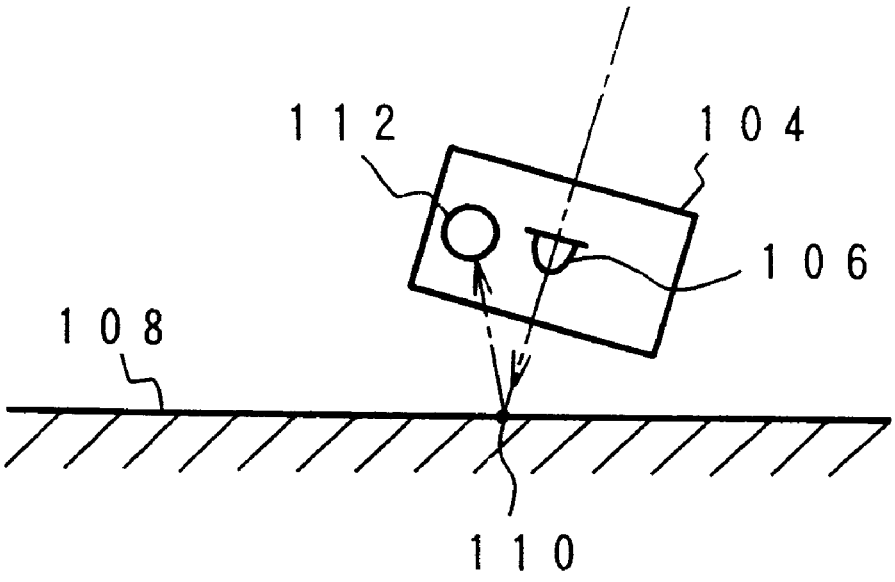
PRIOR ART FIG. 1
FIG. 1 is an explanatory diagram of a conventional sensor receiving a toner diffuse reflection light.
Figure 2:
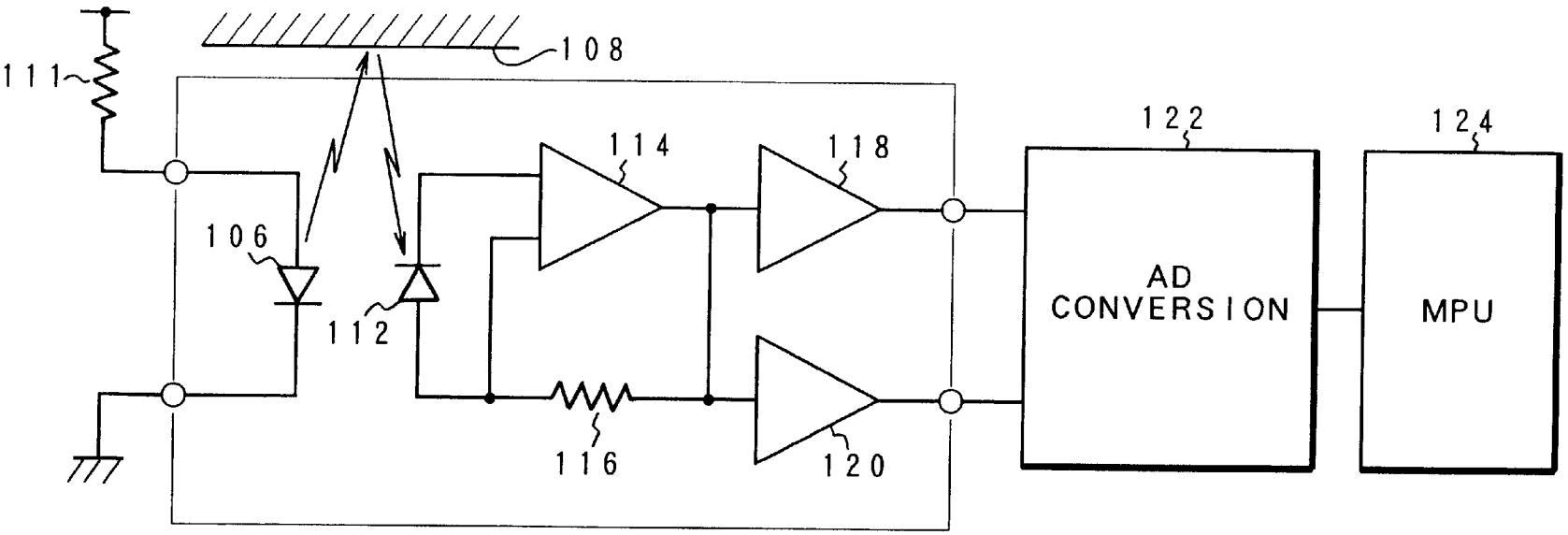
PRIOR ART FIG. 2
FIG. 2 is an explanatory diagram of a conventional sensor circuit.
Figure 3A:
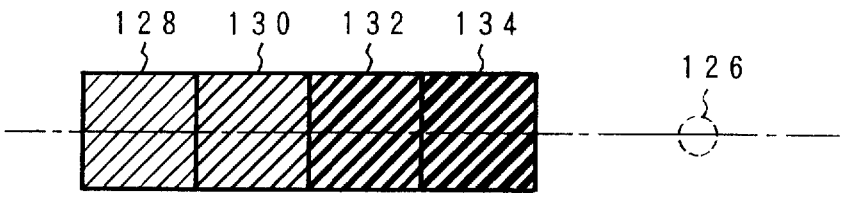
FIGS. 3A to 3C are explanatory diagrams of output signals for YMC color toners and K black toner in the conventional sensor.
Figure 3B:
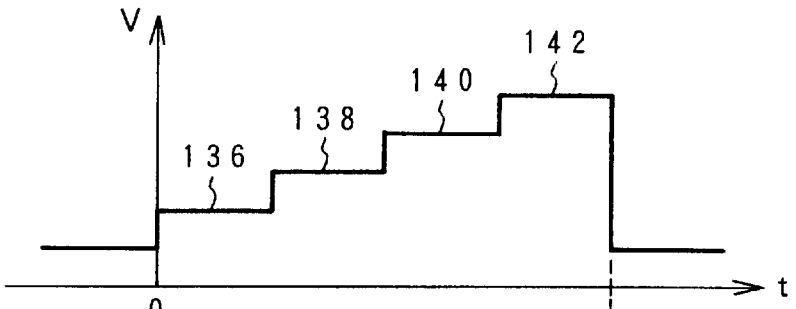
Figure 3C:
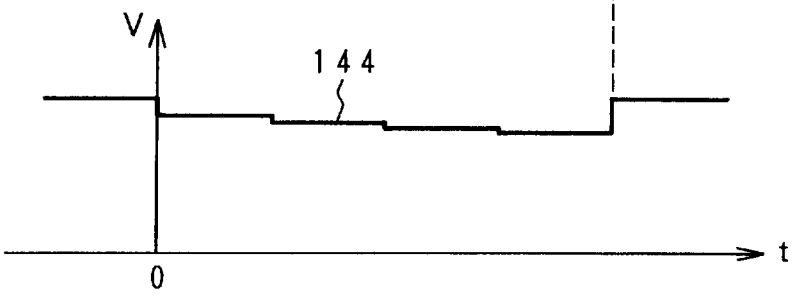
Figure 4:
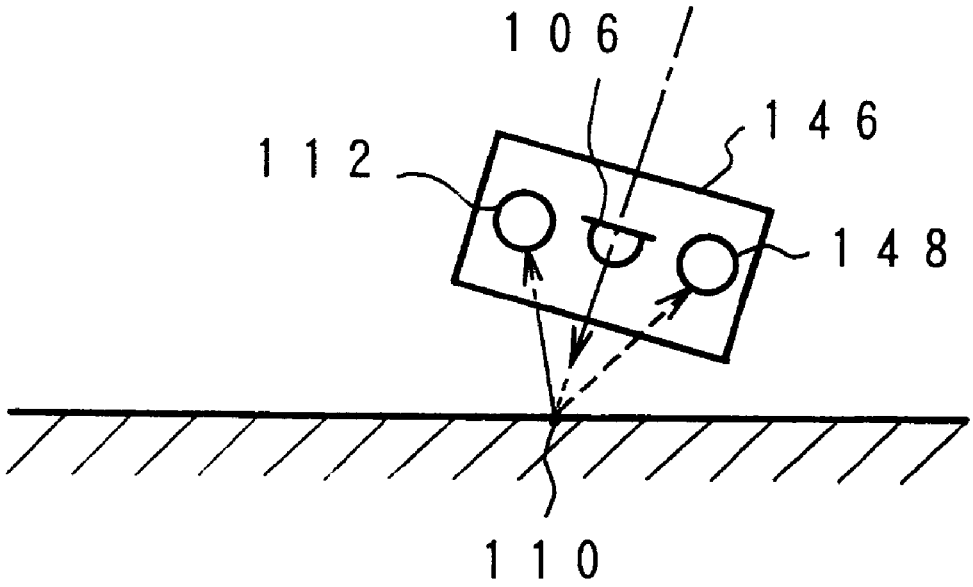
PRIOR ART FIG. 4
FIG. 4 is an explanatory diagram of the conventional sensor performing integrated diffuse reflection light detection and regular reflection light detection.
Figure 5:
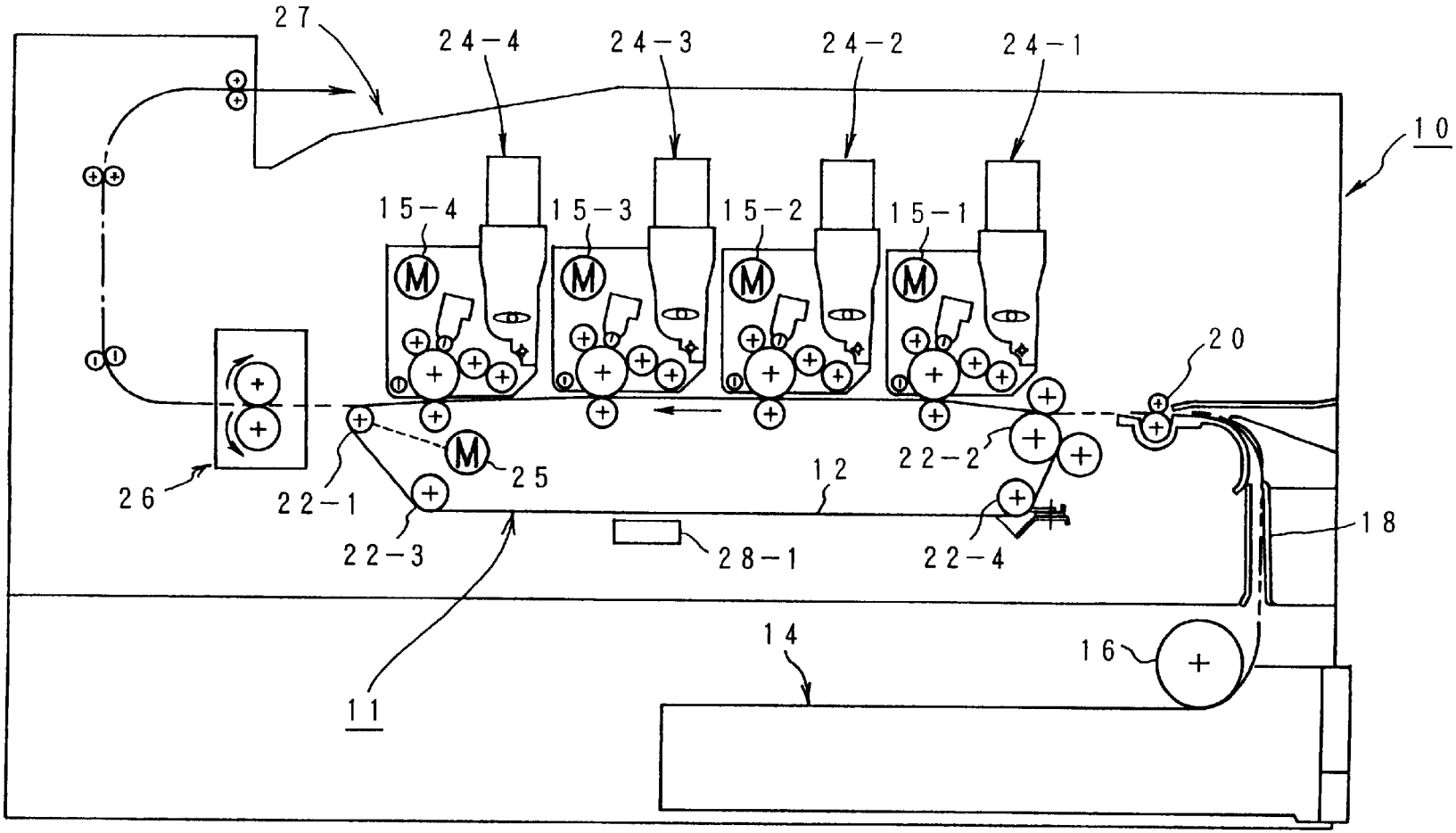
FIG. 5 is an explanatory diagram of the internal structure of a printing apparatus in accordance with the present invention.

FIG. 5 shows the internal structure of a printing apparatus having a toner density measurement function in accordance with the present invention. The interior of an apparatus body generally designated at 10 is provided with a conveyance belt unit 11 for conveying a record medium, e.g., record sheets, the conveyance belt unit 11 having rotatably an endless belt 1 made of a flexible dielectric material, e.g., appropriate synthetic resin material. The endless belt 12 is stretched over four rollers 22-1, 22-2, 22-3 and 22-4. The roller 22-1 functions as a driving roller having a drive mechanism not shown by means of which the endless belt 12 is driven clockwise as indicated by an arrow at a constant speed, e.g., at 54 mm/s. The driving roller 22-1 is driven by motor 25 and serves also as an AC elimination roller for eliminating electric charge from the endless belt 12. The roller 22-2 functions as a driven roller which serves also as a charging roller for imparting electric charge to the endless belt 12. Both the rollers 22-3 and 22-4 act as guide rollers which are disposed in the vicinity of the driver roller 22-1 and the driven roller 22-2, respectively. The upper running part of the endless belt 12 forms a record sheet moving path between the driven roller 22-2 and the driving roller 22-1. A stack of record sheets are stored in a hopper 14 such that they are delivered one by one from the uppermost one in the hopper 14 by means of a pickup roller 16. The record sheets picked up by the pickup roller 16 pass through a record sheet guide passage 18, and are led from the driven roller 22-2 side of the endless belt 12 into the record sheet moving path of the endless belt 12 by means of a pair of record sheet feed rollers 20 and finally discharged from the driving roller 22-1. The endless belt 12 being charged by the driven roller 22-2, the record sheets electrostatically adhere onto the endless belt 12 when they are led from the driven roller 22-2 side into the record sheet moving path, thereby preventing any positional offset of the record sheets in motion. On the other hand, the discharge side driving roller 22-1 serves as a charge elimination roller so that the endless belt 12 is cleared of electric charge at the portion in contact with the driving roller 22-1. For this reason, the record sheets are cleared of electric charge upon the passage through the driving roller 22-1 so that they are readily peeled away and discharged from the endless belt 12 without being entangled in the belt underside. The interior of the apparatus body 10 is provided with four electrostatic recording units 24-1, 24-2, 24-3 and 24-4 for Y, M, C and K which are arranged in series or tandem in the mentioned order from upstream toward downstream along the record sheet moving path on the belt upper side of the endless belt 12 defined between the driven roller 22-2 and the driving roller 22-1.

The electrostatic recording units 24-1 to 24-4 have substantially the same structure excepting the use of yellow toner component (Y), magenta toner component (M), cyan toner component (C) and black toner component (K), respectively, as a developing agent. For this reason, the electrostatic recording units 24-1 to 24-4 transfer yellow toner images, magenta toner image, cyan toner image and black toner image in sequence and in a superposed manner on top of the record sheets moving along the record sheet moving path on the upper side of the endless belt 12, to form full color toner images thereon. As is well known, the electrostatic recording units 24-1 to 24-4 each include a precharger, an array of LEDs acting as an exposure device, a toner developing unit, an electrostatic transfer roller driven by a motor generally designated as motors 15-1, 15-2, 15-3 and 15-4, and a toner cleaner, which are arranged around a photosensitive drum, to perform electrostatic photoprinting in accordance with an electrophotographic process. After the formation thereon of full color images as a result of superposed transfer of four color toners Y, M, C and K by the electrostatic recording units 24-1 to 24-4, the record sheets are delivered from the driving roller 22-1 to a heat roller type thermal fixing device 26, for thermal fixation of the fill color images onto the record sheets. After the completion of the thermal fixation, the record sheets pass through guide rollers and are stacked on a stacker 27 provided on top of the apparatus body. A pair of sensors 28-1 and 28-2 are arranged in the direction orthogonal to the belt moving direction in such a manner as to confront the undersurface of the endless belt 12 in the conveyance belt unit 11, although only the sensor 28-1 closer to the viewer is visible in the state of FIG. 5. The pair of sensors 28-1 and 28-2 detect a toner mark for color drift regulation transferred to the endless belt 12 and optically read a toner mark for toner density measurement in the density regulation. The color matching processing for the color drift regulation and the density regulation in this printing apparatus is carried out when the printing apparatus is activated or when the cover is opened or closed upon the toner replacement of the electrostatic recording units 24-1 to 24-4.

Figure 6A:
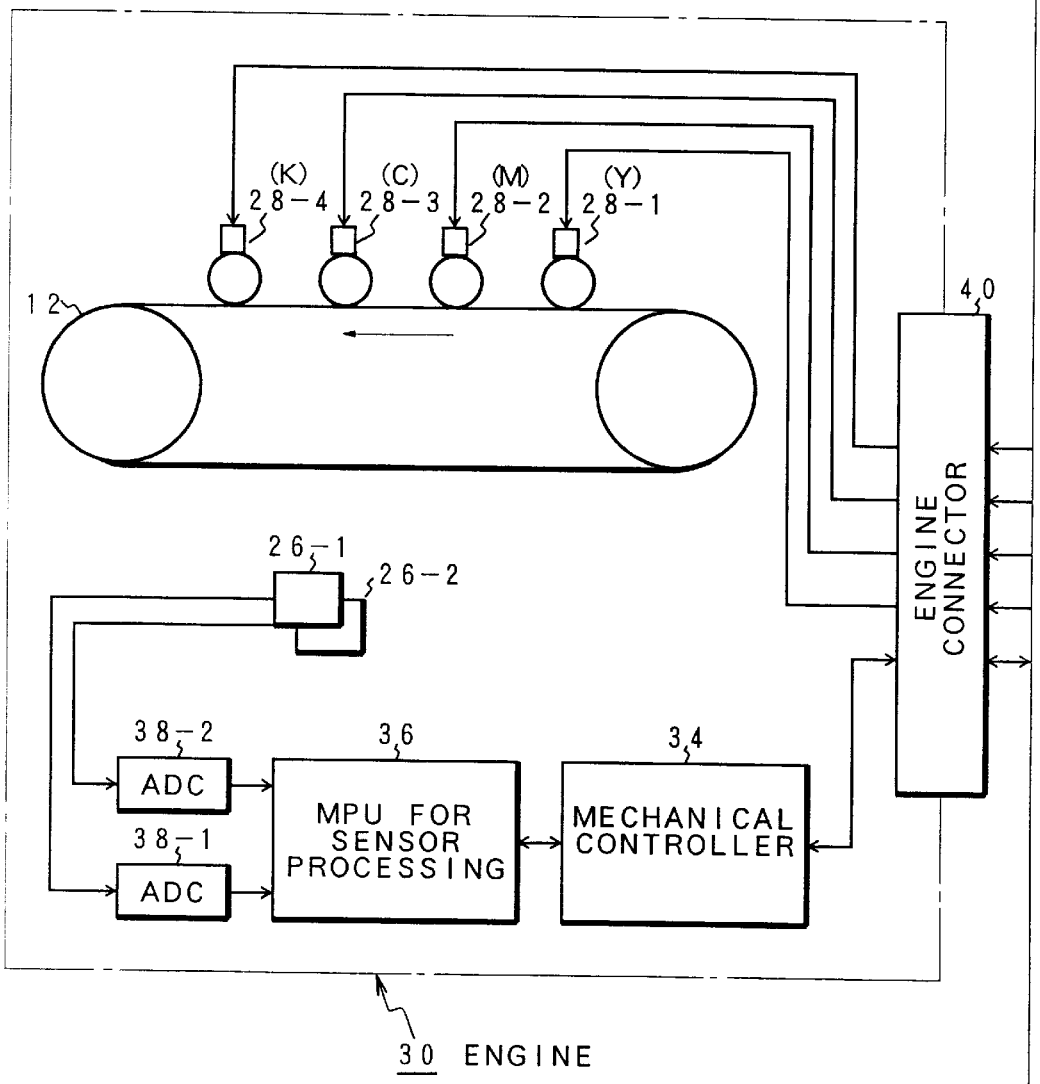
FIGS. 6A and 6B are block diagrams of the hardware configuration of the present invention.
Figure 6B:
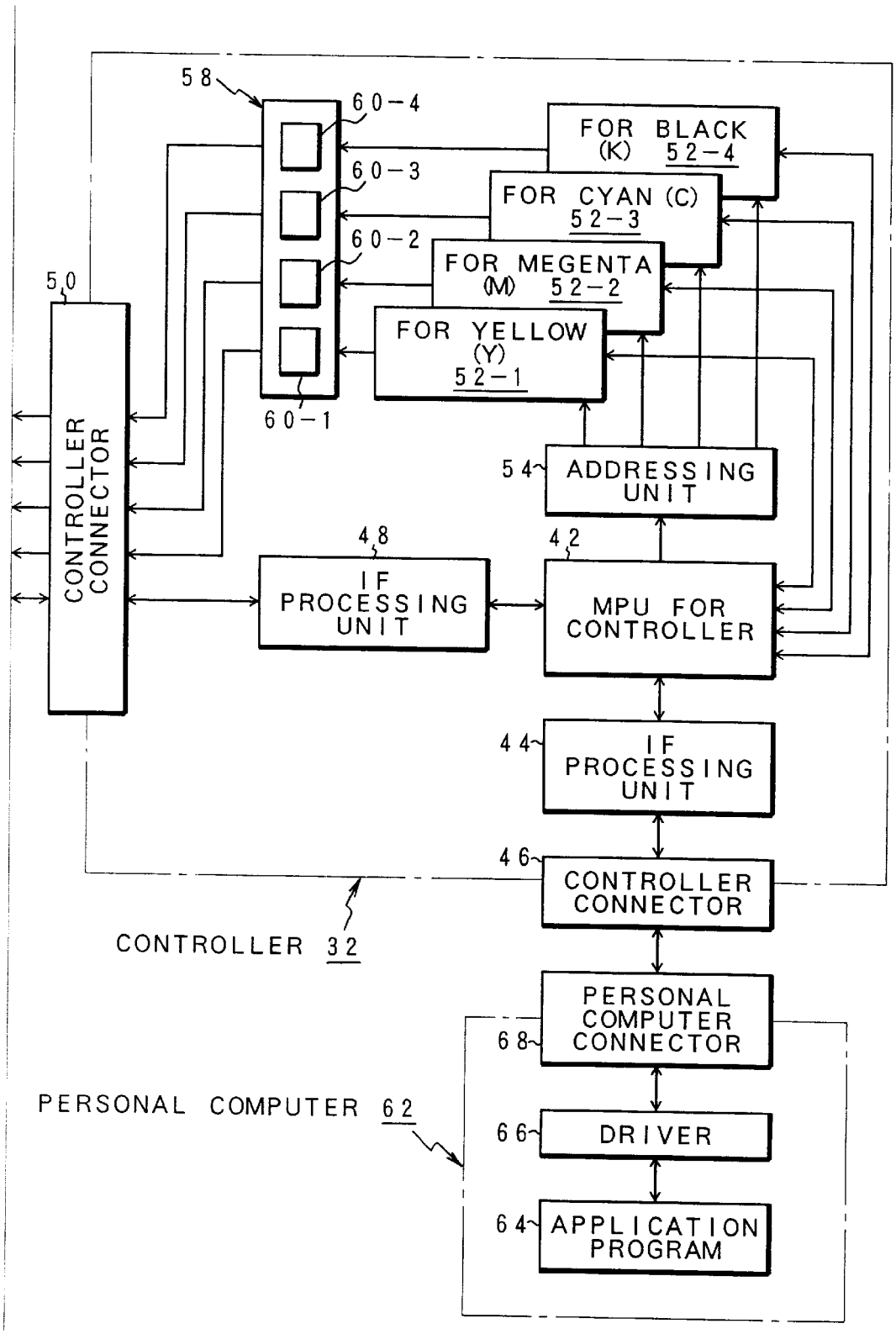

FIGS. 6A and 6B are block diagrams of the hardware configuration of the printing apparatus in accordance with the present invention. The hardware of the printing apparatus of the present invention is constructed of an engine 30 and a controller 32. The engine 30 comprises a mechanical controller 34 for providing control operations of the printing mechanisms such as the conveyance belt unit 11 and the electrostatic recording units 24-1 to 24-4 of FIG. 5. The mechanical controller 34 is associated with an MPU 36 for sensor processing which executes the toner density measurement processing in accordance with the present invention upon the density regulation processing. The MPU 36 for sensor processing accepts detection signals from the pair of sensors 26-1 and 26-2 disposed below the endless belt 12, in the form of digital data sampled by A/D converters 38-1 to 38-2. The mechanical controller 34 is connected via an engine connector 40 to the controller 32 side. Exclusively shown herein as the printing mechanisms provided in the engine 30 are the endless belt 12 and sensors with LED arrays 28-1, 28-2, 28-3 and 28-4 acting as the exposure devices provided in the respective electrostatic recording units for Y, M, C and K. The controller 32 comprises an MPU 42 for controller. A personal computer 62 for example as the host is connected to the MPU 42 for controller by way of an interface processing unit 44 and a controller connector 46. The personal computer 62 is provided with a driver 66 for printing color image data provided from any desired application program 64, the driver 66 being connected via a personal computer connector 68 to the controller connector 46 of the controller 32. The MPU 42 for controller of the controller 32 is provided with image memories 52-1, 52-2, 52-3 and 52-4 for expanding for storage into pixel data (dot data) Y, M, C and K image data transferred from the personal computer 62. On the other hand, the MPU 42 for controller is connected to the engine 30 by way of an interface processing unit 48 and a controller connector 50 so that the interface processing unit 48 can accept positional offset information and toner density information detected by the engine 30 side to perform color matching processing containing the positional offset correction and toner density correction for each of the toner image data expanded into the image memories 52-1 to 52-4. The MPU 42 for controller is provided with an addressing unit 54 for performing addressing upon the expansion of the respective color pixel data into the image memories 52-1 to 52-4. The addressing unit 54 has also a function for performing address conversion for positional offset correction based on the positional offset information provided from the engine 30 side.

Figure 7:
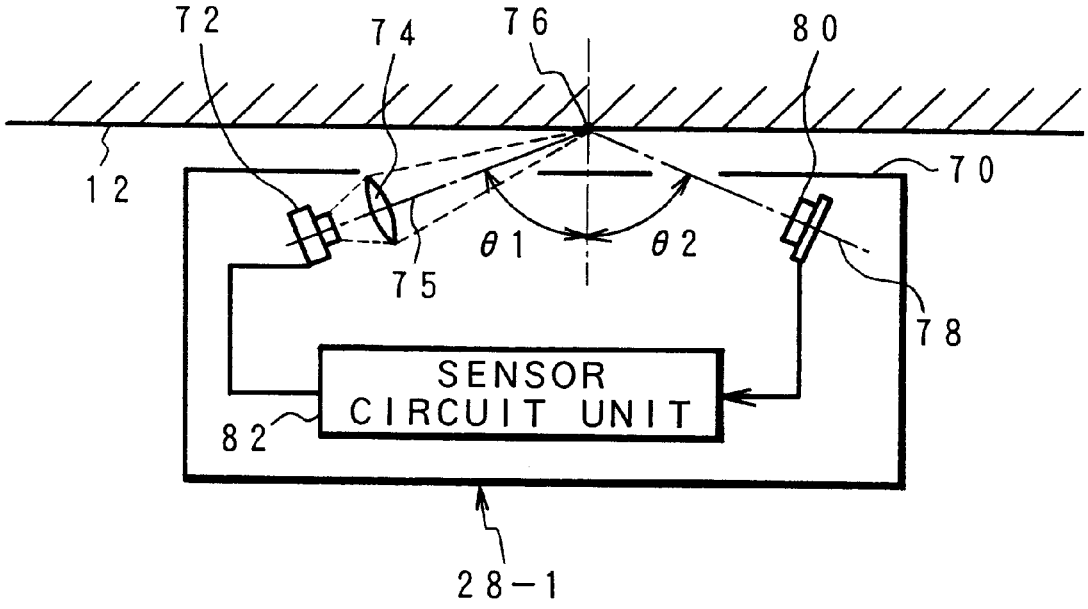
FIG. 7 is an explanatory diagram of a sensor unit of the present invention.

FIG. 7 is an explanatory diagram of a sensor 28-1 disposed below the endless belt 12 shown in the engine 30 side of FIGS. 6A and 6B. The sensor 28-1 comprises a housing 70 facing the underside of the endless belt 12, a laser diode 72 acting as a light source and a photodiode 80 acting as a light receiving element, the two diodes being arranged within the housing 70. The laser diode 72 issues laser beams having a wavelength of e.g., 780 nm and condenses the beams by an image forming lens 74 positioned on an incident optical axis 75, to form a minute beam spot on an image forming position 76 on the endless belt 12. The diameter of the beam spot of the laser beams irradiated on the image forming position 76 is reduced to about several tens of micrometers for example. The photodiode 80 is positioned on an reflected optical axis 78 from the image forming position 76. The incident angle θ1 of the incident optical axis 75 relative to the belt surface is equal to the output angle θ2 of the reflected optical axis 78 relative thereto. The incident angle θ1 and the output angle θ2 are set to the range of 60 to 80 degrees for example, and preferably to 70 degrees as a result of experiments of the inventors of this application. In the relationship between the incident optical axis 75 equipped with the laser diode 72 and the image forming lens 74 and the reflected optical axis 78 equipped with the photodiode 80, a minute beam spot through the image forming lens 74 from the laser diode 72 is irradiated on the image forming position 76, the direction of regular reflection from which is defined as the reflected optical axis on which is placed the photodiode 80 as the light receiving element. For this reason, in the absence of toner transferred on the belt 12, the beam spot from the laser diode 72 is regularly reflected on the belt surface, with the regularly reflected beam impinging on the photodiode 80 to issue a light reception signal to a sensor circuit unit 82. In case of transfer of a toner mark onto the belt 12 for toner density measurement, the movement of the transferred toner mark to the image forming position 76 may cause the irradiated beam to be diffusely reflected by the toner particles as a result of irradiation of the beam spot reduced from the laser diode 72, whereupon the reflected quantity-of-light impinging on the photodiode 80 arranged on the reflected optical axis 78 is reduced so that the light reception signal lowers as compared with the absence of the toner.

Figure 8:
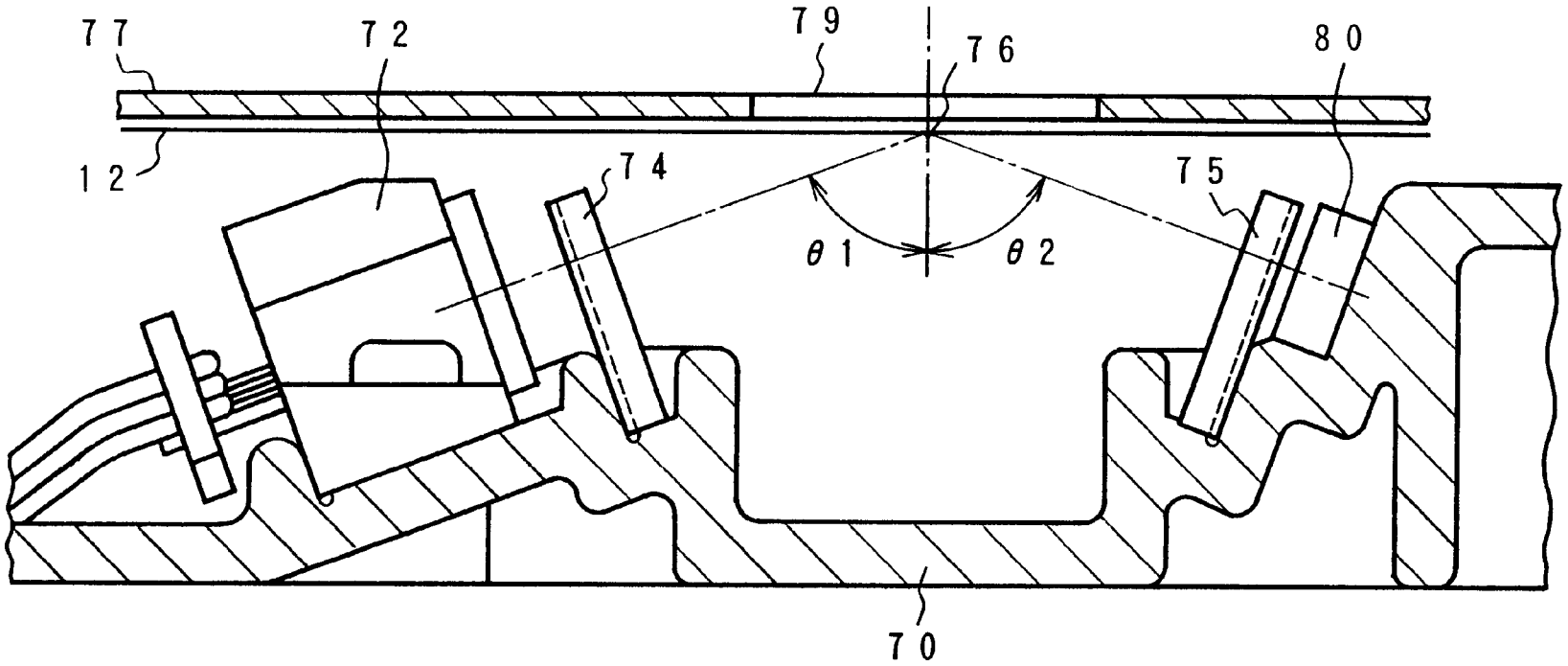
FIG. 8 is an explanatory diagram of a specific embodiment of FIG. 7.

FIG. 8 is a sectional view of a specific embodiment of the sensor 28-1 of FIG. 7. The laser diode 72 is disposed on the left side in the housing 70, the image forming lens 74 with a collimator being disposed in front of the laser diode 72. The beams of light from the laser diode 72 are condensed through the image forming lens 74 so that a minute beam spot is formed with the incident angle θ1 at the image forming position 76 on the belt surface 12. The photodiode 80 is disposed by way of a condenser lens 75 in the optical axis direction with the output angle θ2 from the image forming position 76 on the belt 12. In the sensors of the present invention, for the toner density measurement the toner marks are transferred onto the surface of the belt 12 using the K, C, M and Y toners in sequence so that the toner marks are detected by the sensors. In this case, the toner marks transferred onto the surface of the belt 12 are unfixed toners substantially without any luster, with the result that the irradiation of the minute spot onto the unfixed transferred toners will cause a diffuse reflection to reduce the quantity-of-light received. Herein, the endless belt 12 is guided along a guide plate 77 positioned on the back side. This allows a scattered light to strike on the photodiode 80 as a result of reflection on the guide plate 77 positioned on the back side of the image forming position 76 on which the beam spot from the laser diode 72 is formed, the scattered light resulting in a noise light. Thus, the guide plate 77 positioned behind the endless belt 12 is provided with a transmitting hole 79 located at the portion from which the noisy scattered light may be generated around the image forming position 76, thereby preventing the occurrence of the noise light by the reflection on the guide plate 77.

Figure 9:
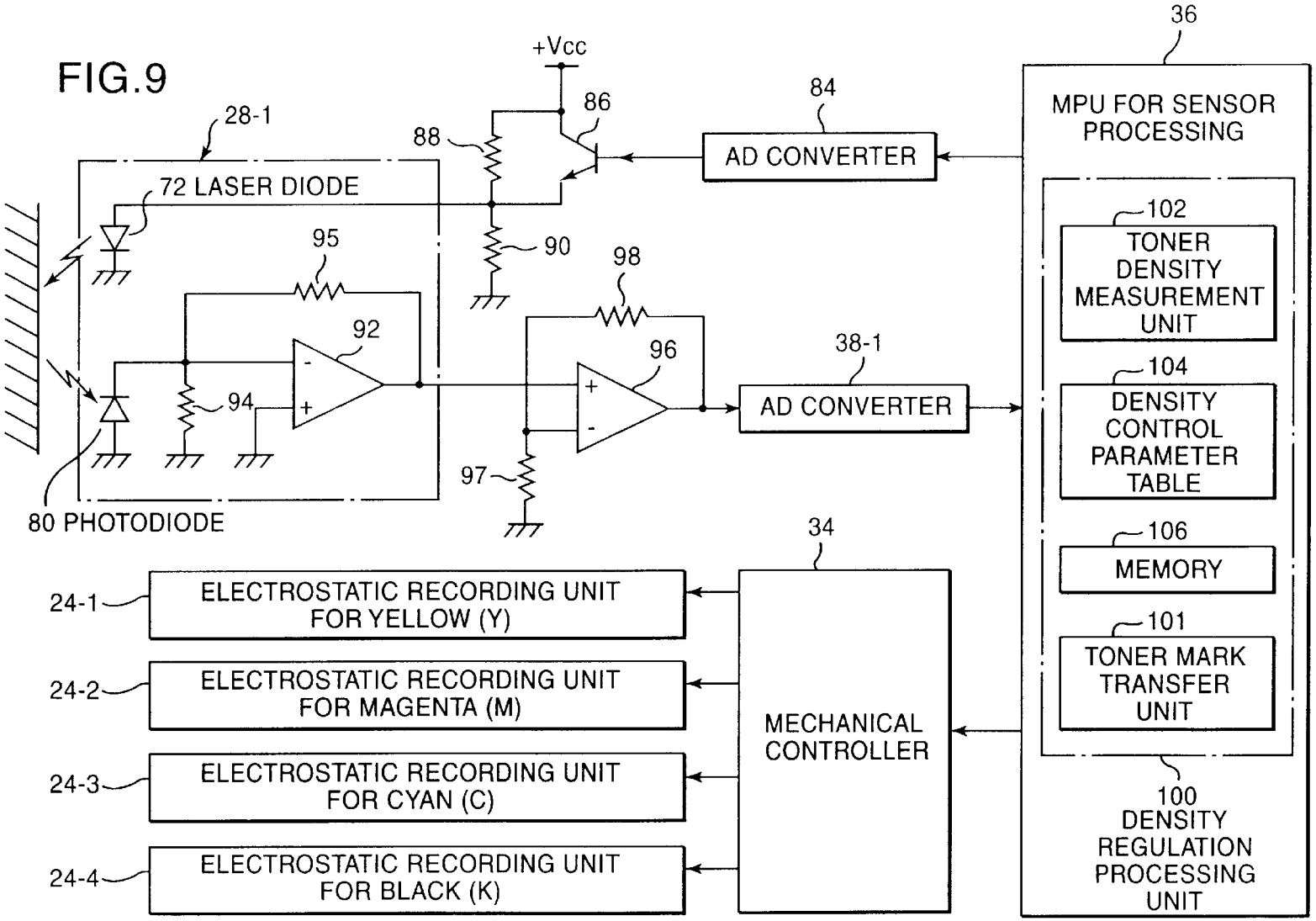
FIG. 9 is a block diagram of a toner density measurement function in accordance with the present invention.

FIG. 9 is an explanatory diagram of a toner density measuring function provided in the printing apparatus of the present invention, showing in conjunction with the sensor circuit unit. The MPU 36 for sensor processing comprises a density regulation processing unit 100 which includes a toner mark transfer unit 101, a toner density measurement unit 102 and a density control parameter table 104. The MPU 36 for sensor processing activates the color matching processing at the time of power on of the printing apparatus or upon the cover opening or closing attendant on the toner replacement to perform the correction of the color drift arising from the toner mark transfer, after which it performs the toner density measurement processing of the present invention. Available as the toner color drift correction of the printing apparatus in the present invention are the ones disclosed in U.S. Pat. No. 5,946,523 or U.S. patent Ser. No. 09/041,006.

The toner mark transfer unit 101 provided on the MPU 36 for sensor processing drives the electrostatic recording units 24-1 to 24-4 by way of the mechanical controller 34 at the time of toner density measurement and transfers halftone patterns with different densities on the belt surface at the detection position by the sensor 28-1 of the endless belt 12, using the control parameter of the density control parameter table 104 set as default for each toner, e.g., using the light emission time which has been set into four stages.

Figure 10A:
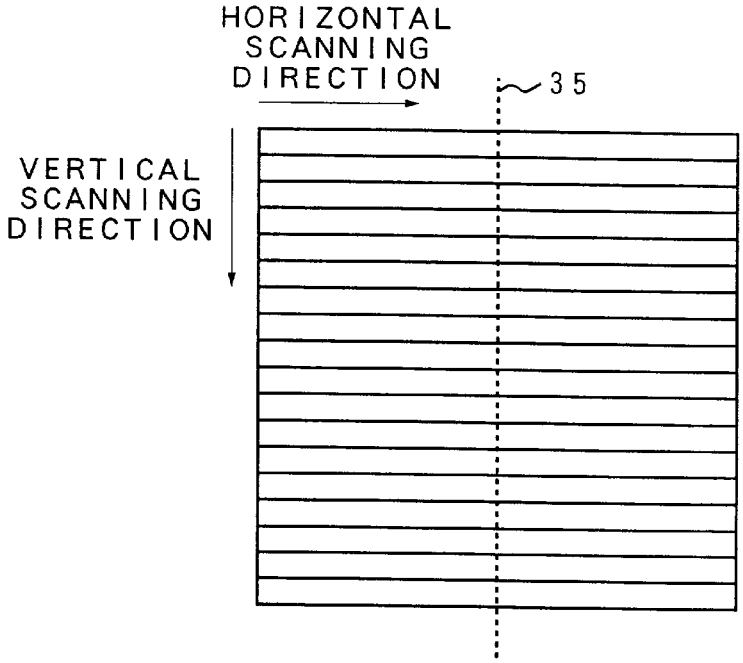
FIGS. 10A and 10B are explanatory diagrams of a half-tone pattern transferred as a toner mark in the present invention.

FIG. 10A shows a halftone pattern for toner density measurement transferred onto the belt surface by the toner mark transfer unit 101, in which a transverse lines is transferred in the horizontal scanning direction orthogonal to a sensor detection line 35, the transverse line being iterated at a constant pitch in the vertical scanning direction to form a transverse line pattern transferred. More specifically, the electrostatic recording units 24-1 to 24-4 use the LED arrays 28-1 to 28-4 as the exposure devices as shown in FIGS. 6A and 6B, and hence the light emission timing in the vertical scanning direction of the LED arrays aligned in the horizontal scanning direction is controlled to e.g., "1on3off" so that the halftone pattern composed of the transverse line pattern as in FIG. 10A is transferred. The thickness of the transverse line in this transverse line pattern can be varied by altering the light emission time in the case of a constant LED emission current. In other words, a shortened emission time results in a reduced line width, whereas an extended emission time results in an increased line width. The reduced line width represents a lower toner density and the increased line width represents a higher toner density. This means that the transverse line pattern line width defines the density area gradation in the halftone pattern.

Figure 10B:
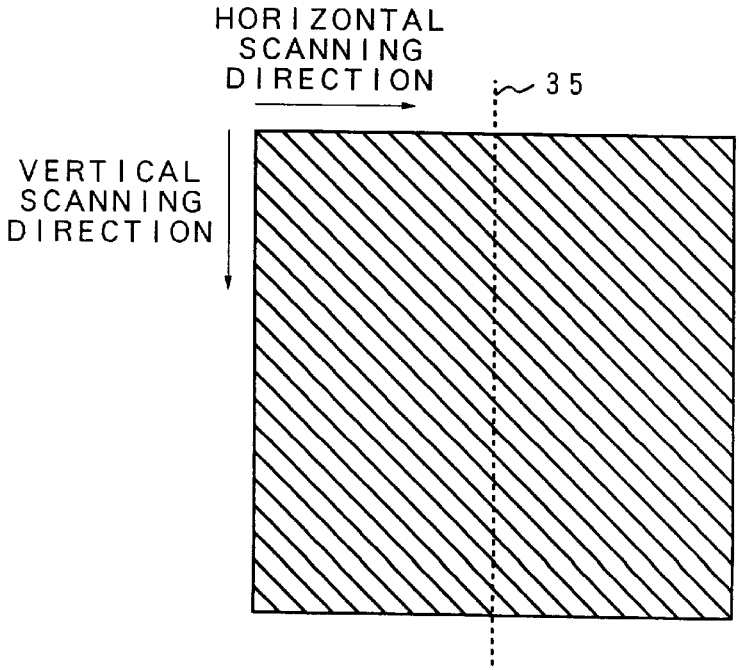

FIG. 10B shows another embodiment of the halftone pattern for use in the toner mark transfer unit 101, in which a slanted line pattern is transferred which is slanted in the horizontal scanning direction and in the vertical scanning direction. In the transverse line pattern of FIG. 10A and the slanted line pattern of FIG. 10B, the halftone pattern required for the toner density measurement of the present invention can be the pattern in which the toner bearing portion and the toner free portion of the halftone pattern are iterated at a constant pitch in the direction of the sensor detection line 35, when viewed from the sensor detection line 35, whereupon the toner bearing portion and the toner free portion can equally be detected at a constant pitch when viewed from the sensor detection line irrespective of the transverse line pattern or the slanted line pattern.

Referring again to FIG. 9, the toner density measurement unit 102 provided in the MPU 36 for sensor processing optically reads by the sensor 28-1 the toner mark of a halftone pattern composed of the transverse line pattern of FIG. 10A or the slanted line pattern of FIG. 10*b* transferred on the belt surface by the toner mark transfer unit 101, and derives the toner density from this read signal. The sensor circuit unit of the sensor 28-1 will first be described. The MPU 36 for sensor processing provides as its output control data whose emission time is controlled with its constant emission time to the A/D converter 84 at the time of toner density measurement, enters the control signal from the A/D converter 84 into the base of a transistor 86 to turn on it, and supplies the emission current to the laser diode 72 with a bias applied to a series circuit of the resistors 88 and 90, for radiation of the laser beams. The laser beams from the laser diode 72 are reflected on the belt surface of the endless belt 12 so that a reflected light strikes on the photodiode 80 for the conversion into a light reception signal which in turn is inversion amplified by an operational amplifier 92 equipped with an input resistor 94 and a feedback resistor 95 and then is non-inversion amplified by an operational amplifier 96 equipped with an input resistor 97 and a feedback resistor 98. The thus obtained light reception signal is sampled by the sampling clock in the A/D converter 38-1 and is fetched as the digital light reception data into the MPU 36 for sensor processing. The toner density measurement unit 102 drives the A/D converter 38-1 when the toner mark of the halftone pattern of FIG. 10A or FIG. 10*b* transferred on the belt surface by the toner mark transfer unit 101 arrives at the detection position of the sensor 28-1, to covert a light reception signal from the operational amplifier 96 at that time into light reception data for the storage in the memory 106. On the basis of the read signal stored in the memory 106, the toner density measurement unit 102 acquires density control parameters corresponding to the toner density, e.g., LED emission time or emission current by reference to the density control parameter table 104, from the ratio of the reflected light from the toner bearing portion and the reflected light from the toner free portion, i.e., from the ratio of the light reception signal.

Figure 11A:
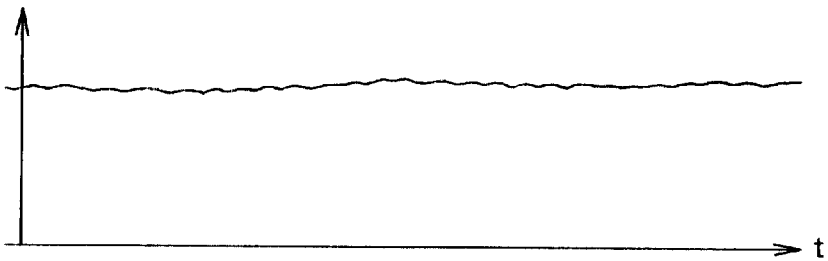
FIGS. 11A to 11C are explanatory diagrams of the toner adhesion amount and a toner mark read signal.
Figure 11B:
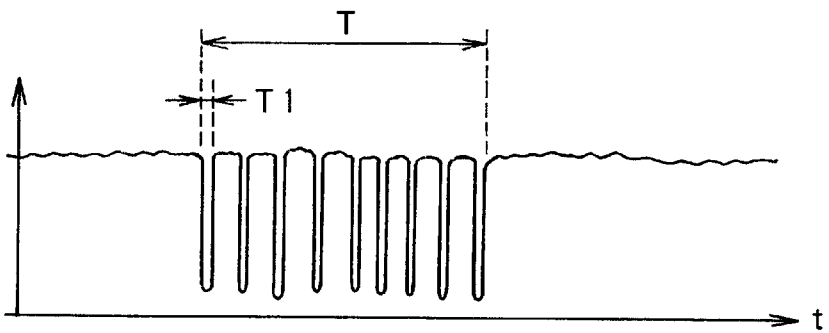
Figure 11C:
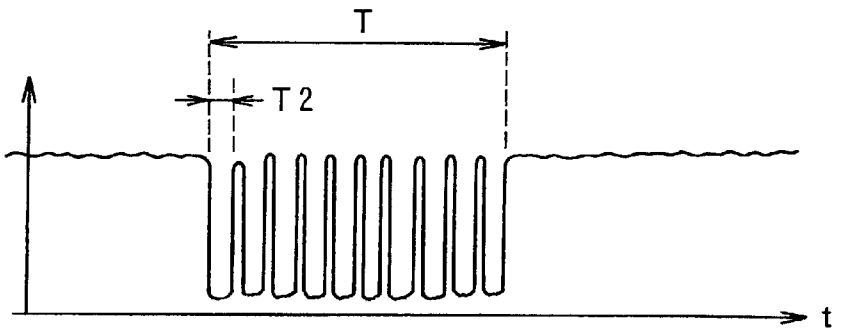

FIGS. 11A to 11C are explanatory diagrams of the read signal of the halftone pattern detected by the sensor 28-1 of FIG. 9. FIG. 11A shows the toner free case in which substantially a constant level of light reception signal is obtained. FIG. 11B shows a read signal of the halftone pattern with a small amount of toner adhesion, in which a reduced level of light reception signal is obtained due to the scattering of the light at the toner adhered transverse line position if the pattern of 10 transverse lines is transferred for example. FIG. 11C shows the read signal in the case of a large amount of toner adhesion, i.e., in the case of large line width of the transverse line pattern of FIG. 10A, in which a reduced level of light reception signal is obtained corresponding to the toner adhered line width. In the light reception signal corresponding to the magnitude of the amount of toner adhesion of FIGS. 11B and 11C, the toner mark read period is the time T from the first signal trailing edge up to the last signal leading edge, the toner mark read period T containing 10 signal level reduced portions. Let T1 be the period during which the signal level is reduced due to the adhesion of the toner of FIG. 11B, and let T2 be the period during which the signal level is reduced due to the adhesion of the toner of FIG. 11C. If the number of times of reduction is 10, then the total of the toner adhesion periods results in 10×T1 and 10×T2, respectively. For this reason, from the ratio of the total of the toner adhesion periods to the toner mark detection period T, the white-to-black ratio WBR indicative of the amount of toner adhesion per unit area can be figured out. That is, the white-to-black ratio WBR is given for FIG. 11B as $$WBR=\{(10\times T1)/T\}\times 100[\%]$$

and for FIG. 11C as $$WBR=\{(10\times T2)/T\}\times 100[\%]$$

In the present invention, the toner density control parameters are determined from the white-to-black ratio WBR obtained from the toner mark detection periods and the toner adhesion periods.

Figures 12A, 12B, 12C:
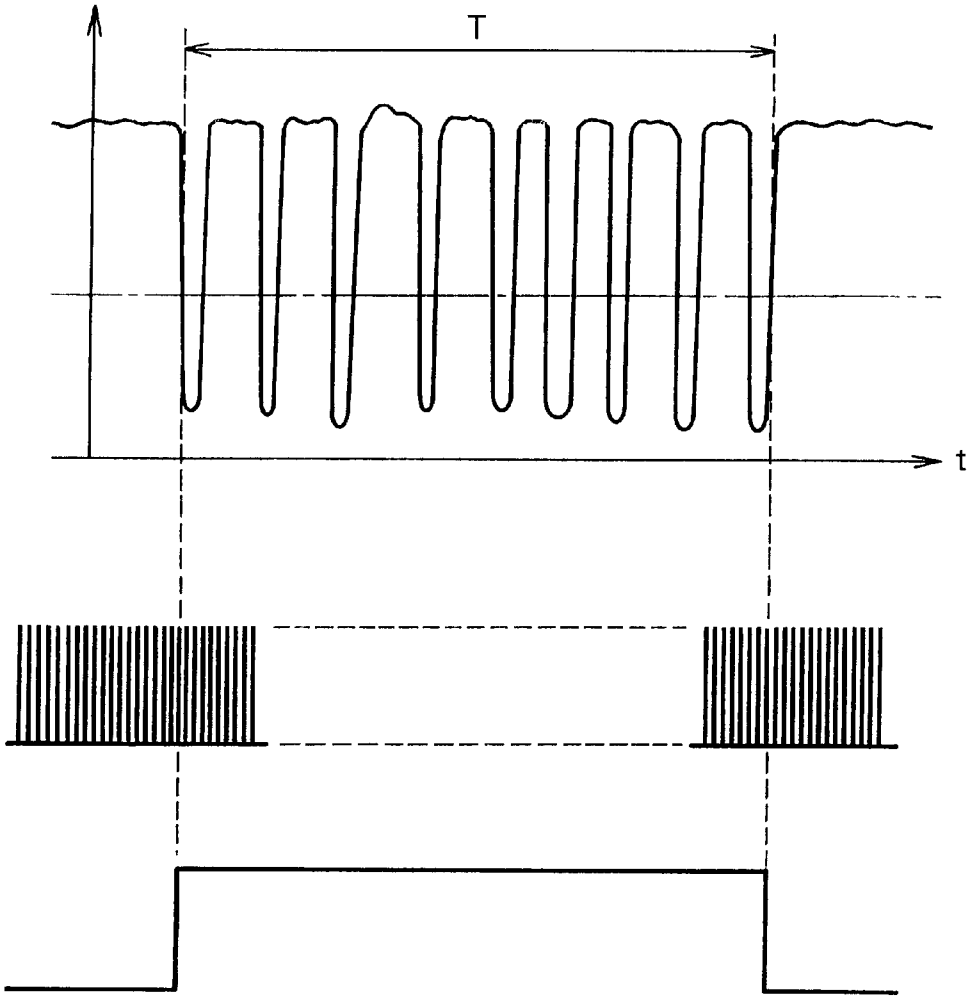
FIGS. 12A to 12C are explanatory diagrams of signal processing for determining a white-to-black ratio from the toner mark read signal.

FIGS. 12A to 12C are explanatory diagrams of the white-to-black ratio calculation processing actually effected in the present invention. FIG. 12A shows an output signal from the sensor, whose signal level is lowered correspondingly to the transverse lines of the toner adhesion for example during the toner mark period T. Then, of this sensor output signal, use is made of a sampling gate corresponding to the sampling pulse of FIG. 12B and to the toner detection feedback of FIG. 12C so that the sensor output signal level at that time is A/D converted for the storage in the memory for each sampling pulse by the operations of the A/D converter 38-1 in synchronism with the sampling pulse. Then, of the sensor output signal after the storage in the memory, a threshold value TH is set which is substantially intermediate between the toner free high level and the toner present low level. The threshold value TH is compared with the sampling data of the sampling gate periods stored in the memory so as to obtain the number NH of the sampling data having the value not less than the threshold value TH and the number NL of the sampling data having the value less than the threshold value TH. After the acquisition of the data number NH not less than the threshold value and the data number NL less than the threshold value in this manner, the white-to-black ratio WBR indicative of the toner density of the read pattern is obtained from $$WBR=\{NL/(NH+NL)\}\times 100[\%] \quad (1)$$

The white-to-black ratio WBR obtained in FIG. 12A becomes same as the white-to-black ratio WBR obtained from the sum total of the toner mark period T and the toner present period in FIGS. 11B and 11C.

FIG. 13 is an explanatory diagram of the density control parameter table 104 of FIG. 9, in which previously entered at four stages as optimum default values are relations between the white-to-black ratio WBR (%) calculated from the expression (1) and the emission time in case of a constant emission current of LEDs in the LED array. The optimum emission times 10 μs, 12 μs, 14 μs and 16 μs classified into four stages of the density control parameter table 104 are used for the exposure of the halftone pattern transferred on the belt surface upon the toner density measurement. After the calculation of the white-to-black ratio WBR by the toner measurement unit 102 from the read signal of the sensor 28-1, reference is made to the density control parameter table 104 of FIG. 13 for the conversion into the emission time using the measured density as the density control parameter. FIG. 14 is another explanatory diagram of the density control parameter table 104 for use in the present invention, in which entered is an emission current with the LED array emission time constant relative to the white-to-black ratio (%). Although FIGS. 13 and 14 show the example of the white-to-black ratio of 10% interval, 5% interval may be employed for further enhanced accuracy, i.e., any appropriate resolving power could be employed as needed.

Figure 15A:
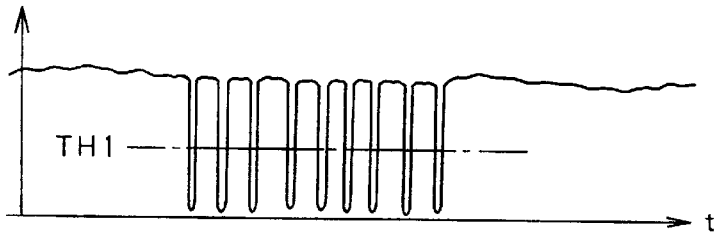
FIGS. 15A to 15D are explanatory diagrams of Y, M, C and K toner mark read signals and threshold values.
Figure 15B:
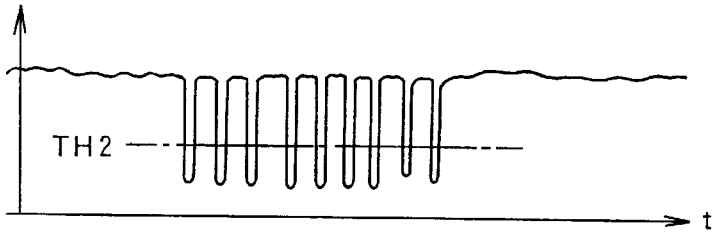
Figure 15C:
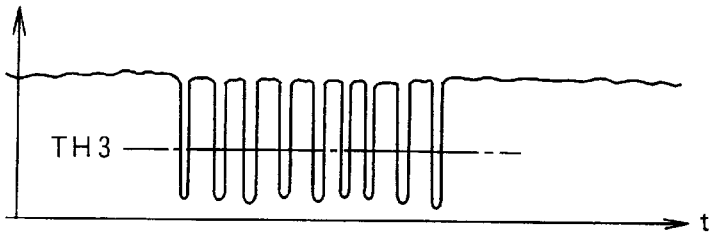
Figure 15D:
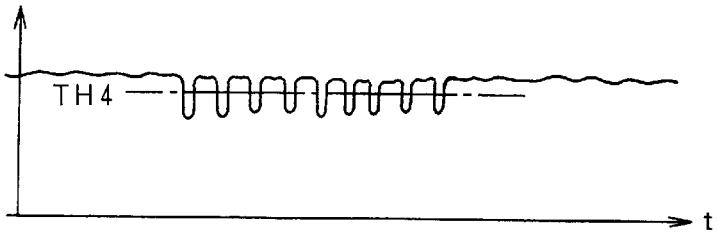

FIGS. 15A to 15D show as a contrasted manner the sensor read signals obtained when the Y, M, C and K toner halftone patterns are transferred onto the belt surface. FIG. 15A shows the Y toner sensor output signal, FIG. 15B shows the M toner sensor output signal, FIG. 15C shows the C toner sensor output signal and FIG. 15D shows the K toner sensor output signal. When these toner sensor output signals are contrasted with one another, the Y toner presents the greatest signal reduction with a slightly smaller signal reduction of the M toner and the C toner. For this reason, as to the Y, M and C toners, the white-to-black ratio can be calculated from the sampling data with the threshold values TH1, TH2 and TH3 equal to substantially half of the signal level of the toner free case. On the contrary, as to the K toner sensor output signal, the signal attenuation at the toner portion is smaller than the Y, M and C toners although the white-to-black ratio can correctly be figured out from the sampling data by setting the threshold value TH4 to substantially intermediate between the toner free level and the toner present level. That is, in the present invention, due to the detection of the line width of the read signal of the halftone pattern by each toner transverse line pattern or slanted line pattern, the white-to-black ratio can be obtained indicative of the correct toner amount of adhesion, i.e., toner density through the detection of the signal reduced portion of the line width corresponding to the toner density, without being influenced by any level variation of the sensor output signals.

Figure 16:
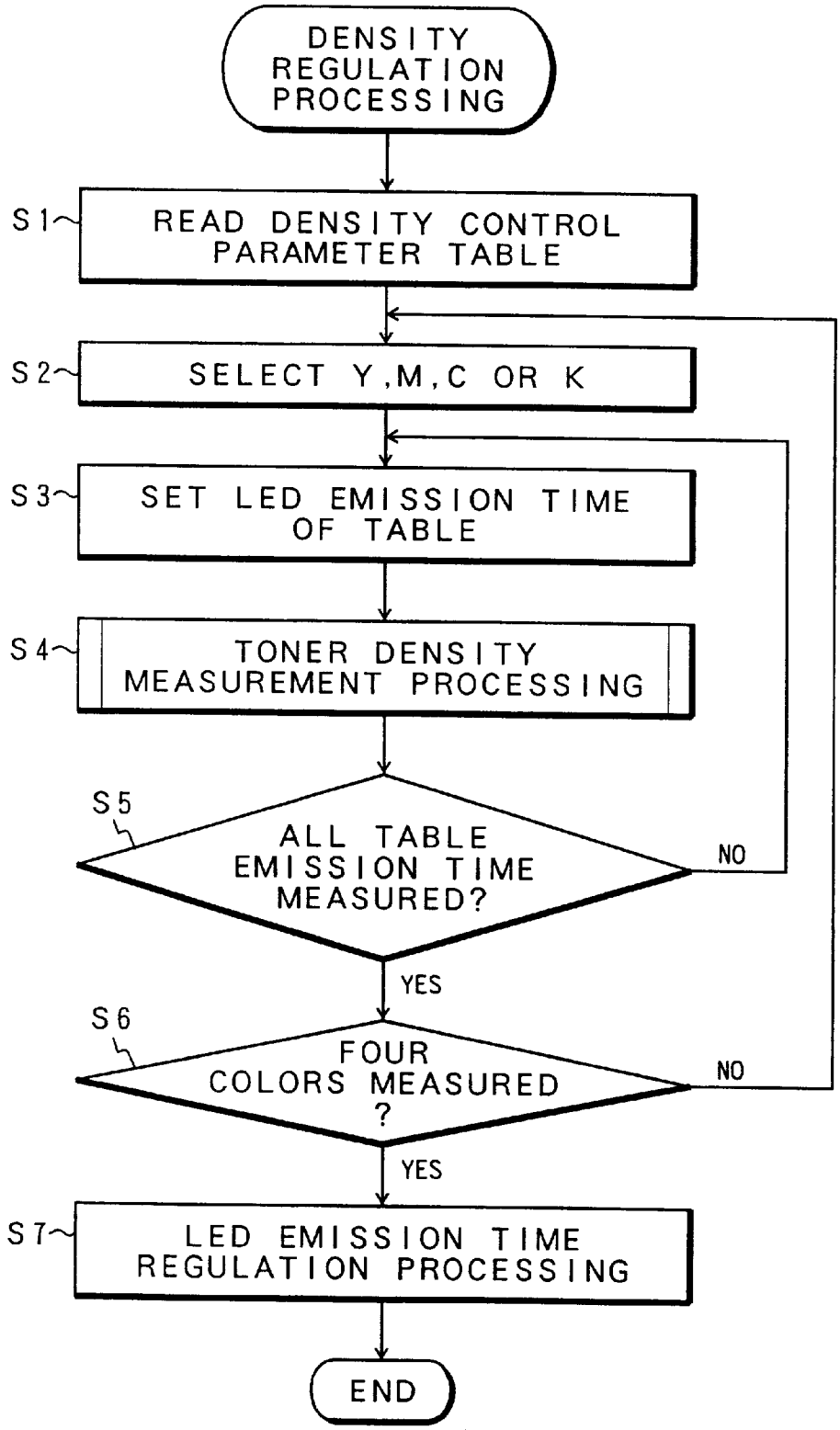
FIG. 16 is a flowchart of density regulation processing based on FIG. 7.

FIG. 16 is a flowchart of the density regulation processing in which the toner density measurement of the present invention is carried out. First, in step S1 the density control parameter table 104 as in FIG. 13 is read. Then in step S2 selection is made of e.g., Y toner as the toner to first be measured, and in step S4 the first LED emission time 10 μs is set from the density control parameter table 104. Then in step S4, the toner density measurement processing of the present invention is carried out. The details of the toner density measurement processing are shown in FIG. 7. From this toner density measurement, the white-to-black ratio WBR is figured out of the halftone pattern transferred through the exposure with the set emission time 10 μs on the belt surface, and reference is made to the density control parameter table 104 to obtain the light emission time. Then in step S5 a check is made to see if all the emission times of the table have been measured or not, and if negative, then the procedure goes to step S3 to make a toner density measurement similarly by setting the next emission time. After the completion of the toner density measurement by the setting of all the emission times, it is checked in step S6 whether the measurement of all the four colors has been completed, and if negative, then the procedure goes to step S3 to select the next M toner to repeat the similar toner density measurement. After the completion of measurement of all the four colors, the procedure goes to step S7 to perform the LED emission time regulation processing. The LED emission time regulation processing includes determining a time lag between the ideal emission time of the density control parameter table 104 and the measured emission time and correcting the table ideal emission time based on this time lag to obtain the emission time used for the actual printing. For example, the white-to-black ratio of 55% is obtained as the result of measurement by the exposed transfer of the halftone pattern using the table emission time 12 μs, and the measurement emission time of 14 μs is obtained at the measured white-to-black ratio 55% in case of departing from the white-to-black ratio range equal to or more than 40% and less than 50%. In this case, the emission lag time is 2 μs, so that the regulation is made, for the actual printing use, to the corrected emission time 10 μs obtained by deducting the lag time 2 μs from the table emission time 12 μs.

Figure 17:
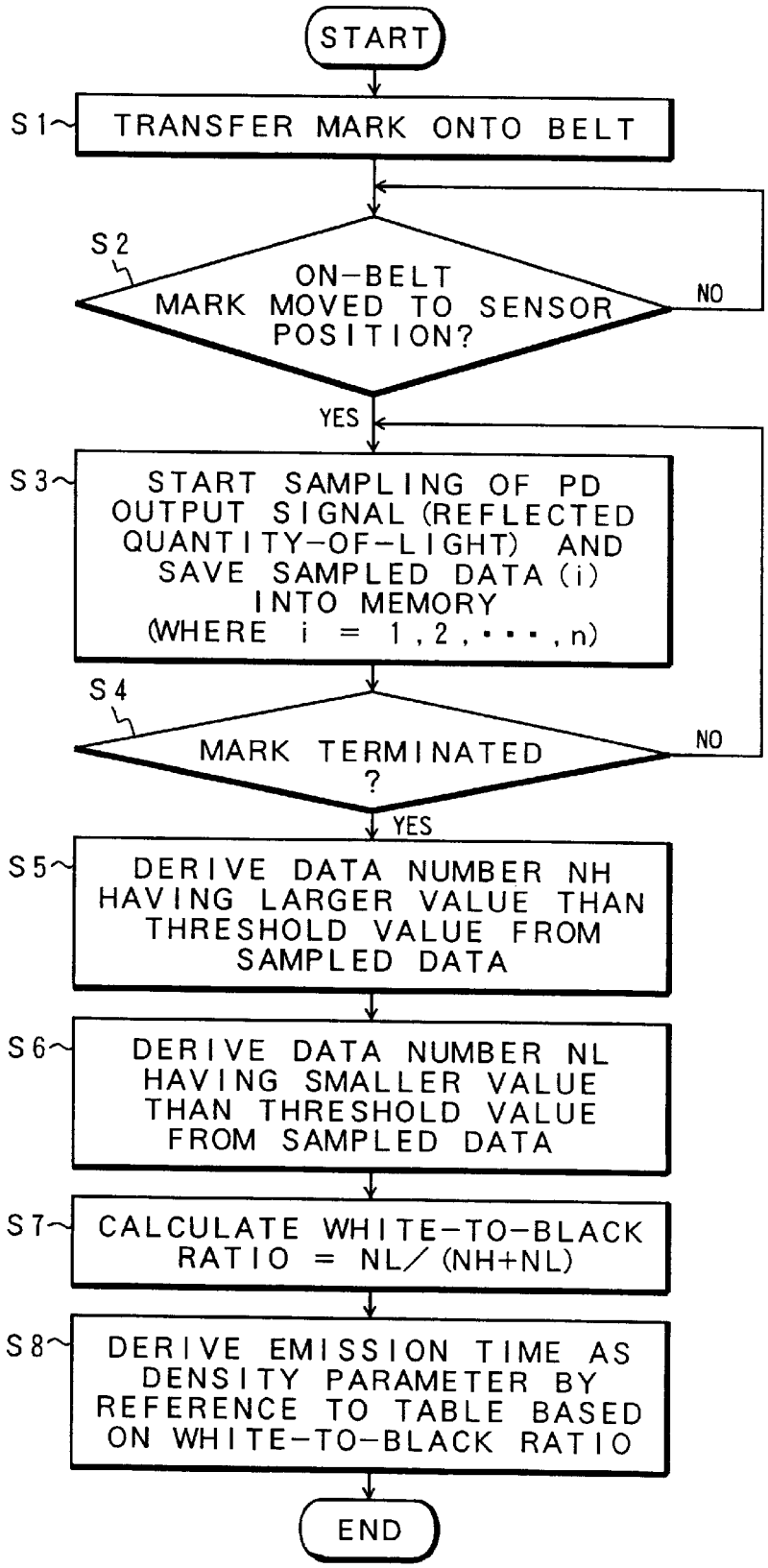
FIG. 17 is a flowchart of toner density measurement processing of the present invention.

FIG. 17 is a flowchart of the toner density measurement processing of the present invention which is the processing of step S4 of FIG. 16. First in step S1, the transverse line pattern of FIG. 10A or the slanted line pattern of FIG. 10B is developed after the exposure through the "1on3off" repetition in the vertical scanning direction of the exposure LEDs so that the halftone pattern is transferred onto the belt surface. Then a check is made in step S2 to see if the toner mark on the belt has reached the sensor position so as to monitor the movement to the sensor position, more specifically, the belt running time from the halftone pattern transfer up to the sensor position, to thereby detect the movement to the sensor position. When the mark on the belt reaches the sensor position, the procedure goes to step S3 to start the sampling of the output signals from the photodiode provided in the sensor and the sampled data D(i) are stored in the memory 106. The memory storage of the sampled data in step S3 is iterated till the mark end in step S4. When the mark is ended, the number NH of data higher than the predetermined threshold value TH is derived in step S5 from the sampled data D(i) stored in the memory. Then in step S6 the number NL of data lower than the threshold value TH is derived from the sampled data. Then in step S7 the white-to-black ratio WBR is figured out from $$WBR=\{NL/(NH+NL)\}\times 100[\%]$$

Finally in step S8, reference is made to the density control parameter table 104 of FIG. 10 for the conversion into the emission time as the density control parameter, to terminate the series of measurement processes allowing the procedure to return to the main routine of FIG. 16.

According to the present invention, as set forth hereinabove, the toner density is measured from the line width substantially proportional to the amount of toner adhesion of the transverse line pattern or the slanted line pattern transferred in the form of the halftone pattern, whereby it is possible to obtain the toner density through secure determination of the line width from the sensor read signal with possible attenuated quantity-of-light for not only the YMC color toners but also for K black toner without relying on the toner reflectance as in the conventional toner density measurement based on the reception signal of a reflected light by the toner diffuse reflection or regular reflection. It is also possible to measure the K black toner and the Y, M and C color toners by the same sensor, the same circuit and the same algorithm, with the high resistance to the analog noises and acquisition of stably high measurement accuracy by virtue of the detection of the line width. Furthermore, the sensors for the toner density detection of the present invention can be of the same sensor structure as that of the sensor for correcting the toner positional offset which similarly effects its work through the toner mark transfer on the belt surface, whereby a single sensor can be used for both the toner positional offset and the toner density measurement to thereby reduce the sensor configuration and costs.

Although the above embodiments have been directed to the printing apparatus using the Y, M, C and K color toners by way of example, it would be applicable intactly to any appropriate apparatuses as long as they transfer a plural kinds of color toners onto the sheets by use of electrostatic recording units which are arranged in tandem. The present invention is not to be limited to the above embodiments but it could variously be modified without departing from its object and spirit. The present invention is not to be restricted by the numerical values indicated in the above embodiments.

What is claimed is:

1. A printing apparatus comprising:

a belt unit which conveys record sheets on a belt at a constant speed, said record sheets being electrostatically adhered to a surface of said belt;

a plurality of electrostatic recording units arranged in a direction of conveyance of said record sheets, said electrostatic recording units forming a latent image corresponding to image data through an optical scanning on a photosensitive drum in rotation by an exposure device, said electrostatic recording units developing said latent image with a toner component of different color, to thereafter transfer said developed image onto said record sheets lying on the surface of said belt;

a toner transfer unit which transfers a halftone pattern onto the surface of said belt by use of said plurality of electrostatic recording units;

a sensor unit which optically reads said halftone pattern transferred onto the surface of said belt; and a toner density measurement unit which measures a toner density on the basis of a ratio of a reflected light from a toner bearing portion to a reflected light from a toner free portion in a read signal of said halftone pattern from said sensor unit.

2. A printing apparatus according to claim 1, wherein said toner transfer unit transfers one of a transverse line pattern and a slanted line pattern on the surface of said belt, a line width of said one of transverse line pattern and said slanted line pattern varying in proportion to the toner density.

3. A printing apparatus according to claim 2, wherein said toner density measurement unit samples at a predetermined cycle a sensor output signal of said one of transverse line pattern and said slanted line pattern transferred onto the surface of said belt, said toner density measurement unit determines a white-to-black ratio using a formula NL/(NL+NH) wherein NH represents a sampled data having a higher value than a predetermined threshold value and NL represents a sampled data having a lower value than said predetermined threshold value.

4. A printing apparatus according to claim 1, wherein said toner density measurement unit refers to a predetermined table information defining a relationship between a white-to-black ratio and a density control parameter, to determine whether said density control parameter corresponds to an amount of adhesion of toner.

5. A printing apparatus according to claim 4, wherein said density control parameter is an emission time when an amount of current flowing per dot of said exposure device is constant or an amount of current when the emission time per dot of said exposure device is constant.

6. A printing apparatus according to claim 1, wherein said sensor unit includes a condenser lens through which a light from a laser diode impinges on the belt surface in the form of a spot light of the order of several tens of microns, said sensor unit, when no toner components adhered thereon the surface, provides a signal of a reflected light, said reflected light being received by a light reception element arranged in a direction of a predetermined output angle, said sensor unit, when toner components adhered thereon the surface, provides a signal of a light attenuated due to scattering of said spot light, said attenuated light being received by said light reception element.

7. A printing apparatus according to claim 1, wherein said sensor unit has an incident angle θ1 from a laser diode relative to the belt surface and an output angle θ2 from the belt surface relative to a light receiving element, said incident angle θ1 and said output angle θ2 being set to a range between 60 and 80 degrees, preferably in a vicinity of 70 degrees.

8. A toner density measuring method for a printing apparatus having a belt unit which conveys record sheets on a belt at a constant speed, said record sheets being electrostatically adhered to a surface of said belt, and having a plurality of electrostatic recording units arranged in a direction of conveyance of said record sheets, said electrostatic recording units forming a latent image corresponding to image data through an optical scanning on a photosensitive drum in rotation by an exposure device, said electrostatic recording units developing said latent image with a toner component of different colors, to thereafter transfer said developed image onto said record sheets lying on the surface of said belt, said method comprising a plurality of steps of:

transferring a halftone pattern onto the surface of said belt by use of said plurality of electrostatic recording units;

optically reading said halftone pattern transferred onto the surface of said belt, by use of a sensor unit; and measuring a toner density on the basis of a ratio of a reflected light from a toner bearing portion to a reflected light from a toner free portion in a read signal of said halftone pattern.

9. A toner density measuring method according to claim 8, further comprising a step of:

transferring one of a transverse line pattern and a slanted line pattern on the surface of said belt, a line width of said one of transverse line pattern and said slanted line pattern varying in proportion to the toner density.

10. A toner density measuring method according to claim 9, further comprising a plurality of steps of:

sampling at a predetermined cycle a sensor output signal of said one of transverse line pattern and said slanted line pattern transferred onto the surface of said belt; and figuring out a white-to-black ratio by using a formula NL/(NL+NH), wherein NH represents a sampled data having a higher value than a predetermined threshold value and NL represents a sampled data having a lower value than said predetermined threshold value.

11. A toner density measuring method according to claim 10, further comprising a step of:

referring to a predetermined table information defining a relationship between said white-to-black ratio and a density control parameter, to determine said density control parameter corresponding to the toner density.

12. A toner density measuring method according to claim 11, wherein said density control parameter is an emission time when an amount of current flowing per dot of said exposure device is constant or an amount of current when an emission time per dot of said exposure device is constant.

13. A toner density measuring method according to claim 8, wherein said sensor unit includes a condenser lens through which a light from a laser diode impinges on the surface of said belt in a form of a spot light of an order of several tens of microns, said sensor unit, when no toner components adhered thereon the surface, provides a signal of a reflected light of said spot light, said reflected light being received by a light reception element arranged in a direction of a predetermined output angle, said sensor unit, when toner components adhered thereon the surface, provide a signal of a light attenuated due to scattering by said spot light, said attenuated light being received by said light reception element.

14. A toner density measuring method according to claim 8, wherein said sensor unit has an incident angle θ1 from a laser diode relative to the surface of said belt and an output angle θ2 from the surface of said belt relative to said light receiving element, said incident angle θ1 and said output angle θ2 being set to a range between 60 and 80 degrees, preferably in a vicinity of 70 degrees.

* * * * *